United States Patent [19]

Marr et al.

[11] Patent Number: 4,512,716

[45] Date of Patent: Apr. 23, 1985

[54] VORTEX TRANSITION DUCT

[75] Inventors: M. Louise McHenry, Indianapolis; Robert C. Bremer, Jr., Brownsburg, both of Ind.

[73] Assignee: Wallace Murray Corporation, New York, N.Y.

[21] Appl. No.: 430,245

[22] Filed: Sep. 30, 1982

[51] Int. Cl.[3] ..... F01D 1/08; F01D 25/24

[52] U.S. Cl. ..... 415/205; 415/219 B

[58] Field of Search ..... 415/203–207, 415/219 B, 219 C

[56] References Cited

U.S. PATENT DOCUMENTS 4,177,005 12/1979 Bozung et al. ..... 415/205 X 4,381,171 4/1983 Chapple ..... 415/204

FOREIGN PATENT DOCUMENTS 56-975 5/1981 Japan ..... 415/205

*Primary Examiner*—Robert E. Garrett

*Assistant Examiner*—Joseph M. Pitko

*Attorney, Agent, or Firm*—Thomas J. Greer, Jr.

[57] ABSTRACT

A turbine housing construction particularly adapted for use with turbochargers for internal combustion engines. A vortex transition duct is inserted between the source of exhaust gas for driving the turbine and the exhaust gas inlet of the turbine volute. In prior turbocharger constructions, the distribution of the velocity of the exhaust gas fed to and as seen by the turbine volute inlet is uniform. Yet, it is desirable that the radial velocity distribution of exhaust gases entering the turbine volute be of a free vortex distribution. The vortex transition duct of this invention transforms the uniform radial velocity distribution of the exhaust gases, prior to their entry into the turbine volute inlet, into a free vortex distribution.

18 Claims, 12 Drawing Figures

FIG. 1
(PRIOR ART)
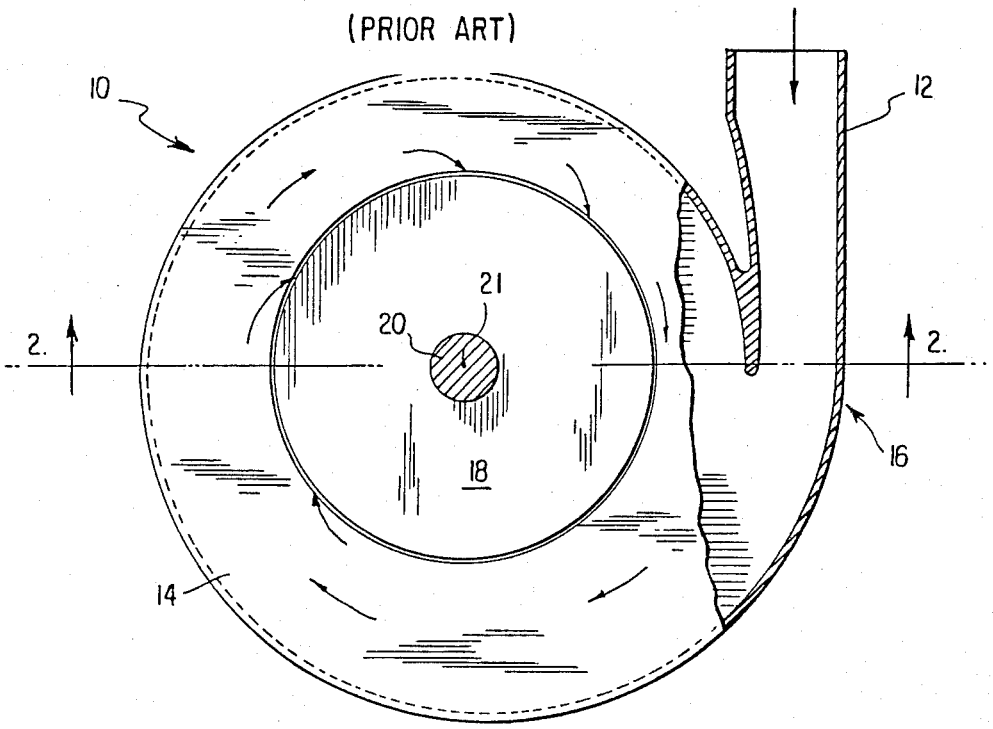
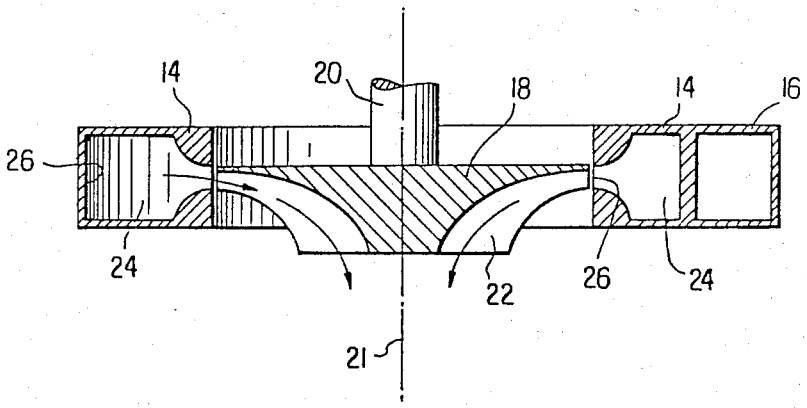
FIG. 2
(PRIOR ART)
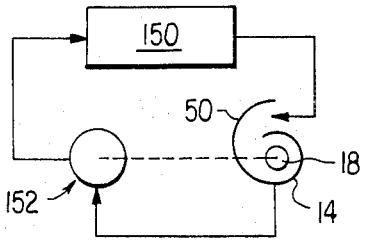
FIG. 12

VORTEX TRANSITION DUCT

This invention relates to a turbine housing construction particularly adapted for use for the turbine side of a turbocharger for internal combustion engines.

A turbocharger may be regarded as a combination compressor and turbine, the compressor wheel and turbine wheel mounted on opposite ends of a common shaft. Exhaust gases from the internal combustion engine, or at least a portion of them, are fed to the turbine. The energy of the gases, in passing through the turbine wheel, causes the common shaft to rotate. This rotation causes the compressor wheel to also rotate, thereby drawing in and compressing ambient air which is then fed into the intake manifold of the internal combustion engine. This arrangement of turbine and compressor is well known and is similar to a supercharger, except that in the case of the supercharger, the compressor is rotated by a direct mechanical connection to the crankshaft.

In the usual pipe connections from the exhaust manifold of the internal combustion engine to the turbine volute inlet of the turbocharger, no special arrangement or construction of pipes is employed, other than whatever form is convenient to lead or to duct the exhaust gases to the turbine volute inlet (excluding also cases for special ducting; for instance, manifold tuning). In general, the distribution of the exhaust gas velocity as it exits from the pipe leading from the internal combustion engine, is approximately uniform. Thus, the turbine volute inlet sees a uniform velocity of exhaust gas.

After entering the turbine volute inlet, the exhaust gas travels in a curved or arcuate path through the interior of the curved turbine volute interior. As the gas passes along the curved interior of the turbine volute, it tends to assume, by virtue of known aerodynamic laws, a free vortex velocity distribution. A free vortex velocity distribution in this environment means that a particle in the exhaust gas which is nearer to the inner radius of the interior of the turbine volute has a greater velocity relative to the velocity of a particle in the exhaust gas at the radially outermost portions of the turbine volute, i.e., the velocity of a particle is inversely proportional to the radius, or distance, from the center of rotation of the turbine wheel.

In accordance with this invention, it has been discovered that if the initial velocity distribution of the exhaust gas fed to the turbine volute inlet is distributed in a free vortex fashion, then turbine efficiency improves. Further in accordance with the practice of this invention, a means of effecting this transformation from uniform velocity distribution to free vortex velocity distribution is carried out by a vortex transition duct. This duct receives exhaust gas from the engine, such exhaust gas exhibiting the usual uniform velocity distribution of the gas over the entire cross-sectional area of the exhaust gas pipe. By means of the geometry of the vortex transition duct of this invention, this velocity distribution is transformed from a uniform velocity distribution at the inlet of the vortex transition duct to a free vortex velocity distribution at the exit of the vortex transition duct.

Without the vortex transition duct of this invention, the naturally-occurring transformation of velocities from uniform distribution to free vortex distribution, which occurs within the turbine volute, is accompanied by shear stresses acting within the exhaust gas to enhance the development or attainment of the naturally occurring free vortex flow. These shear stresses are a function of the velocity gradient within and the viscosity of the exhaust gas. The viscous effects represent useful energy lost from the gas, which energy cannot be regained. This loss results in a decrease in the tangential momentum of the exhaust gas. It is well known in turbomachinery design that high tangential momentum is desirable at the turbine rotor inlet, since it is the tangential momentum of the exhaust gas which results in the transfer of energy from the exhaust gas to the turbine rotor.

In the transition from a uniform velocity distribution to a free vortex distribution within the turbine volute, certain losses due to shear stresses are encountered, as has been explained above. A somewhat similar action occurs in the vortex transition duct of this invention. However, in distinction to the losses due to shear forces within the gas in the turbine volute, the losses which occur in the vortex transition duct of this invention are lower. This decrease in losses is due to the fact that the vortex transition duct of this invention is specifically contoured to carry out a single function, namely, the function of changing the velocity distribution of the gas entering the vortex transition duct from a uniform velocity distribution to a free vortex velocity distribution at the exit of the vortex transition duct. Although shear stress losses may occur within the votex transition duct, the duct is designed with three-dimensional convergence with curvature in such a manner as to contour the velocity profile, via the pressure gradients established within the duct of this invention, to transform the uniform velocity distribution into a free vortex velocity distribution.

According to one embodiment of the vortex transition duct of this invention, the duct inlet is rectangular in shape, while its exit is generally trapezoidal. In order to match the inlet to the turbine volute to the exit of the vortex transition duct, the inlet to the turbine volute is also made generally trapezoidal. The radially innermost curved surface of the duct interior is a circular arc, while the radially outermost surface of the duct is a circular arc, while the radially outermost surface of the duct interior is also a circular arc, but of greater radius and with a different center from the innermost arc. By virtue of this configuration, the flow along the radially innermost duct surface accelerates more rapidly than the flow on the radially outermost duct surface, thereby contributing to the action of the vortex transition duct in transforming the incoming velocities to a free vortex radial distribution of velocities. Three specific embodiments of the transition duct are set forth.

IN THE DRAWINGS

FIG. 1 is a partial cross-sectional view of a typical prior art turbine for a turbocharger.

FIG. 2 is a view taken along section 2—2 of FIG. 1.

FIG. 12 is a partially schematic view showing the turbine housing construction of this invention in combination with a compressor and an internal combustion engine.

Figure 3:
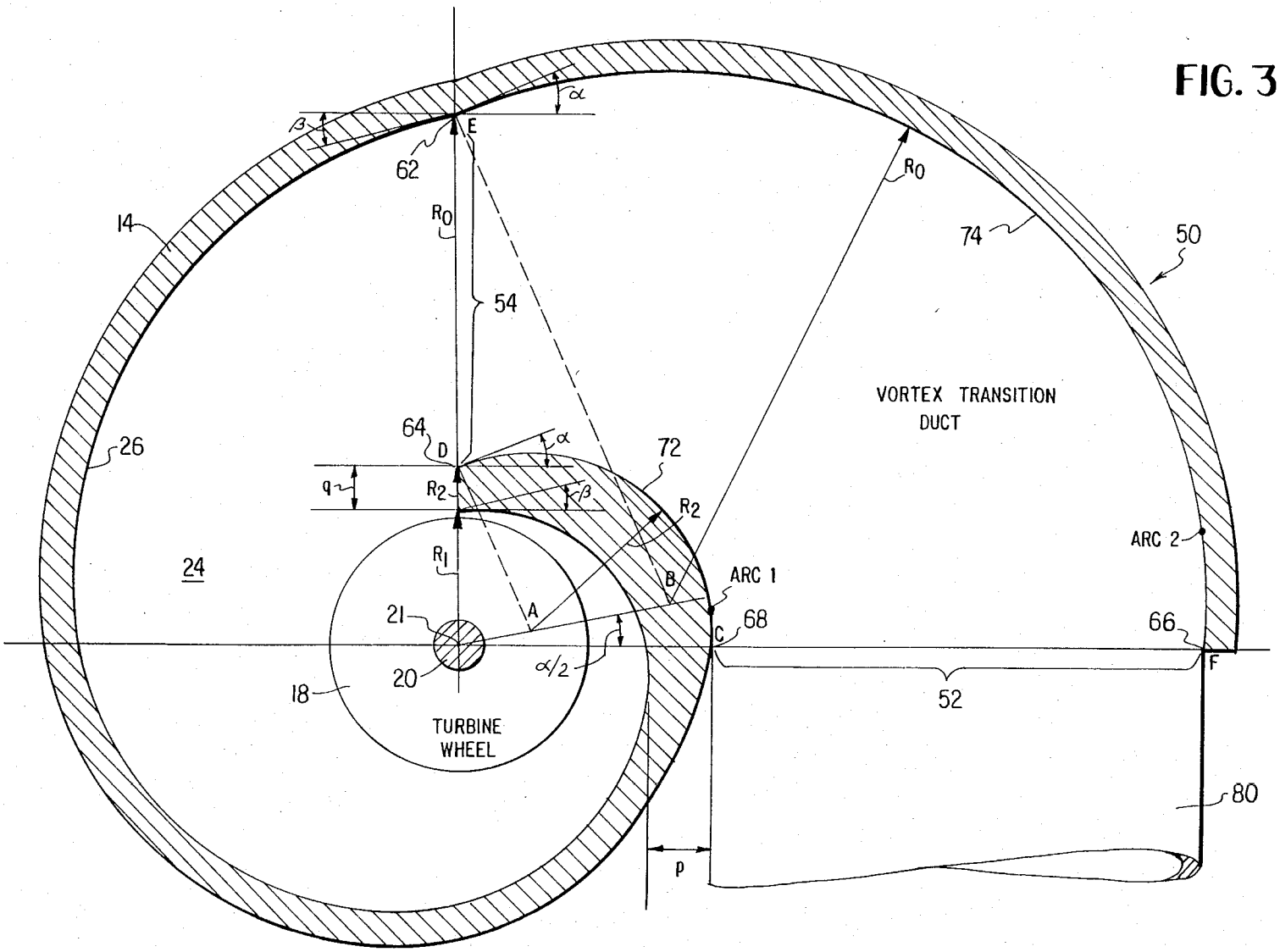
FIG. 3 is a partially schematic view, similar to FIG. 1, illustrating the configuration of the vortex transition duct of this invention as applied to a typical prior art turbine for a turbocharger.

Referring now to FIGS. 1 and 2 of the drawings, a typical prior art turbine housing construction is illustrated. The numeral 10 denotes generally the turbine housing, the housing including an inlet duct 12 which receives the exhaust gas from the exhaust manifold of an internal combustion engine. While shown here as integral with the turbine housing, the duct 12 may be separate and joined thereto by means of a suitable coupling such as a bolt and flange coupling. The numeral 14 denotes the outermost curved portion of the turbine volute, here in the form of a spiral. The numeral 16 denotes the inlet to the turbine volute for the exhaust gas. The numeral 18 denotes a conventional radial inflow turbine wheel mounted on shaft 20 for rotation about axis 21. The numeral 22 denotes any of a plurality of blades integrally formed with turbine wheel 18. The numeral 24 denotes the interior of the turbine housing, the radially innermost portion of the interior having an annularly continuous surface 26 along which the exhaust gas passes to the outermost periphery of the turbine wheel 18 and thence axially along blades 22. The interior may be regarded as a curved and elongated flow path of a continuous annular nozzle 26.

A typical prior art turbine housing is shown in U.S. Pat. No. 2,944,786 issued to Angell, after which FIGS. 1 and 2 are taken.

Figure 4:
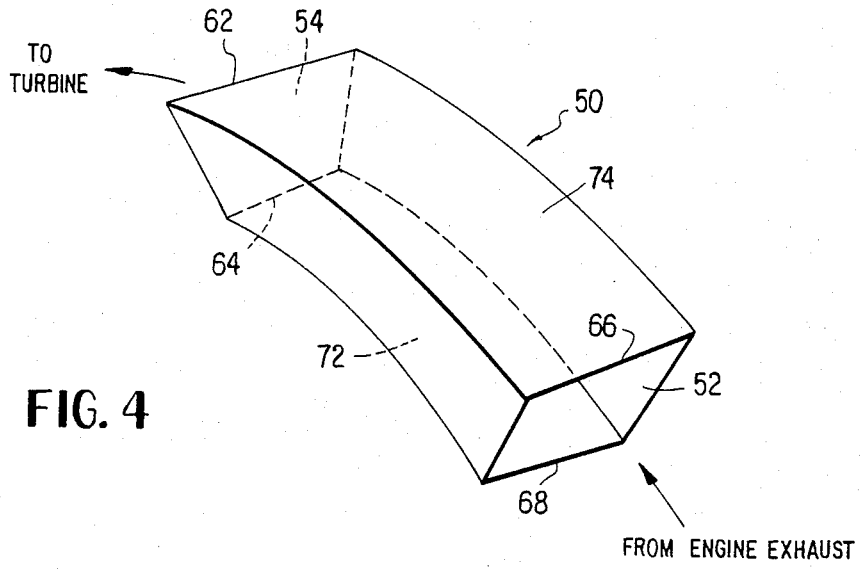
FIG. 4 is a schematic view of the vortex transition duct of this invention.

Referring now to FIGS. 3 and 4 of the drawings, the lowermost and leftmost portion of FIG. 3 represents a partial cross-sectional view of a typical prior art turbine volute, such as the turbine housing of FIGS. 1 and 2. The numeral 14 thus corresponds to the outermost portion of the turbine volute, while numeral 24 again represents the curved flow path of the volute interior. The numeral 26 denotes the radially outermost portion or surface of the flow path in the volute, also shown at FIG. 3 in the form of a spiral. A spiral surface, such as surface 26, is already known in this art, as shown for example in the noted Angell patent.

The numeral 50 denotes generally the vortex transition duct of this invention (here also see FIG. 4) having an inlet area or throat 52 which is generally rectangular. The numeral 62 denotes the radially outermost portion of a generally trapezoidal exit 54, while the numeral 64 denotes the radially innermost portion of the generally trapezoidal exit 54. The numeral 66 denotes the radially outermost portion of the vortex transition duct inlet throat 52, while the numeral 68 denotes the radially innermost portion of inlet throat 52. The numeral 74 denotes the radially outermost curved surface, being a circular arc of transition duct 50, while numeral 72 denotes the radially innermost surface of the transition duct, also in the form of a circular arc. The two sides of the duct 50 are curved, so that the transition from rectangular to generally trapezoidal may be effected. It is apparent that the inlet to the turbine volute 14 is generally trapezoidal, so as to match the generally trapezoidal exit 54 of the transition duct 50.

The numeral 80 denotes any pipe coupling from the exhaust manifold of an internal combustion engine to the inlet throat 52 of transition duct 50. Any mode of coupling of duct 80 to the throat 52 may be employed, such as a flange and bolt coupling.

Figure 5:
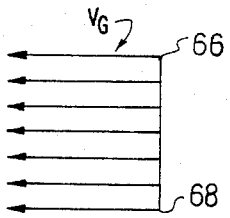
FIG. 5 is a schematic view representing the uniform velocity distribution at the inlet to the vortex transition duct of this invention.
Figure 6:
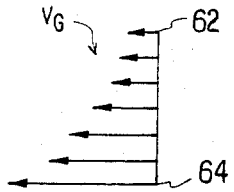
FIG. 6 is a view similar to FIG. 5, but showing the free vortex velocity distribution of the exhaust gas as it exits from the vortex transition duct of this invention.

FIG. 5 schematically designates the distribution of radial velocity of the exhaust gas from the internal combustion engine as it exits from duct 80 into transition duct 50. It is seen that the velocity distribution is uniform, i.e., at all regions over inlet 52 of the duct 50 (coupled to the exhaust of pipe 80) the velocity of the exhaust gases is constant. FIG. 6 indicates the velocity distribution of the exhaust gas as it exits from exit 54 of transition duct 50 into the inlet of the turbine volute 14. FIG. 6 shows that the distribution is non-uniform, with the greatest velocities being at those radially innermost portions and the lowest velocities being at the radially outermost portions of the transition duct. This distribution, fed directly into the turbine volute, yields improved turbine efficiency as compared with the distribution of FIG. 5.

Again referring to FIG. 3 of the drawings, the letter q designates the thickness of the volute 14 at its terminus. At the terminus, the exhaust gas has passed around 360° since entering the turbine volute inlet 54. The letter p indicates the thickness of the volute 14 at a point 270° from the turbine volute inlet. These thicknesses of regions p and q are dictated by known design considerations.

Still referring to FIG. 3, $R_o$ designates the distance from the axis of rotation 21 to the radially outermost part of the transition duct exit 54 of duct 50. $R_1$ designates the distance from axis of rotation 21 to the radially innermost part of the terminal portion of the volute 14. $R_2$ designates the distance from axis 21 to the radially outermost portion of the terminus of the volute 14, this being coincident with the shorter generally trapezoidal edge 64 of exit 54 of the transition duct 50.

The center for radius $R_2$, which generates the radially innermost surface 72 of the transition duct, is denoted by point A. The point B is the center of curvature for the radially outermost surface 74 of the transition duct, and is of a radius $R_o$. Point C of FIG. 3 is seen to be the intersection of surface 72 (Arc 1) with a horizontal line represent 270° in a counter-clockwise direction from the inlet to turbine volute 14. Point D is coincident with edge 64, in the plane of FIG. 3. Point O is at the axis of rotation 21. Points E and F are the extremes of surface 74.

Points A and B are determined in the following manner. First, an arc of length $R_2$ is struck with center at point D. An arc of length $R_2$ is struck with center at point C. The intersection of these arcs is the center of Arc 1 and is denoted by A. Next, with the center of Arc 1 at point A, an arc of length $R_2$ is drawn which connects points D and C, thus defines surface outline 72.

The angle $\alpha$ is the angle between the horizontal at point D and the tangent to Arc 1 at point D. The distance $\overline{OA}$ is given as $$\overline{OA} = \{2(R_2)^2 - 2(R_2)^2 \cos \alpha\}^{\frac{1}{2}}$$
$$= 2\ R_2 \sin (\alpha/2)$$

It can be shown using trigonometric and geometric relationships that $\overline{OA}$ makes an angle of $\alpha/2$ with the horizontal at point O.

Arc 2 is the outermost streamline (surface 74) of the vortex transition duct and is constructed in the following manner. First, line $\overline{OA}$ is continued radially outwardly at an angle $\alpha/2$. Next, an arc of length $R_o$ is struck with center at point E (at edge 62). The intersection of the resultant arc with the continuation of segment $\overline{OA}$ determines the center B of Arc 2 (surface 74). Next, with the center at point B, an arc of radius $R_o$ is drawn connecting points E and F.

Since a turbocharger is generally applied in a limited space and is generally sized for a particular engine, peripheral limiting geometry is usually involved. This geometry includes radius $R_o$, volute inlet inner radius $R_1$, and material thicknesses p and q. Mass flow, air pressure, temperature in the engine exhaust manifold and horsepower requirement complete the thermodynamic application requirements. The rectangular passageway 52 at the vortex transition duct inlet is necessary in order to match the engine exhaust manifold coupling. Given these design parameters and length (in degrees before turbine volute inlet) of the vortex transition duct, a specific vortex transition duct rectangular inlet is defined along with a generally trapezoidal exit. Also there will exist a specific side wall angle ($\delta$) of the housing which must be specified to support a free vortex velocity distribution around the rotor inlet. $\delta$ is defined as $$\delta = \tan^{-1}\left(\frac{2\ (R_o - R_i)}{W_o - W_i}\right)$$

Figure 7:
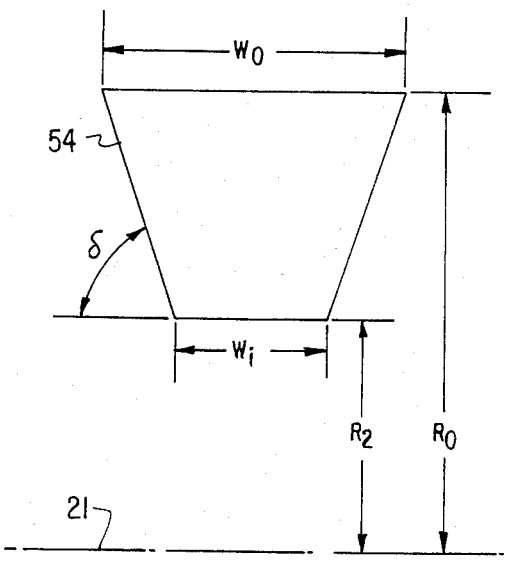
FIG. 7 is a view of the exit of the vortex transition duct of this invention.

FIG. 7 illustrates the angle delta ($\delta$).

Figure 8:
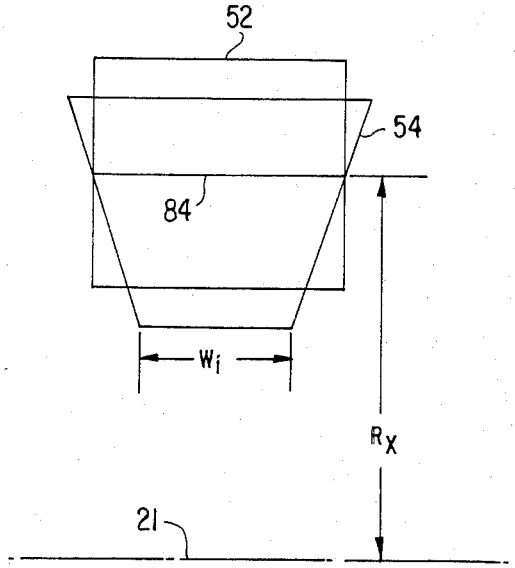
FIG. 8 is a schematic view illustrating the relative transition from the inlet of the vortex transition duct to the exit of the vortex transition duct of this invention.

FIG. 8 shows that there exists a certain radius $R_x$ at which the width of the transition duct inlet and the width of the turbine volute inlet are equal, this length denoted by 84. At all radii (measured from turbine wheel axis 21) R greater than $R_x$, the transition duct width is divergent towards the turbine volute inlet and at all radii R less than $R_x$ 84, the transition duct width is convergent towards the turbine volute inlet. Therefore, along the outer wall of the transition duct which includes surface 74, the width is diverging to $W_o$ at the turbocharger inlet. Along the inner wall 72, the width is converging to $W_i$ at the turbocharger inlet. This divergence/convergence of the transition duct width in conjunction with the convergence of the inner and outer duct walls, establishes the free vortex radial velocity distribution at the turbine volute inlet.

While performing the function of redistribution of velocities, the transition duct of the embodiment of FIG. 3 exhibits certain aerodynamic discontinuities between or associated with streamlines of flow. According to a second embodiment, now to be described, the thickness p and q are increased and the angles alpha and beta (of FIG. 3) are equal. An inspection of the uppermost portion of FIG. 3 reveals that if angles alpha and beta are equal, then the transition between Arc 2 and the volute will be aerodynamically smooth.

Figure 9:
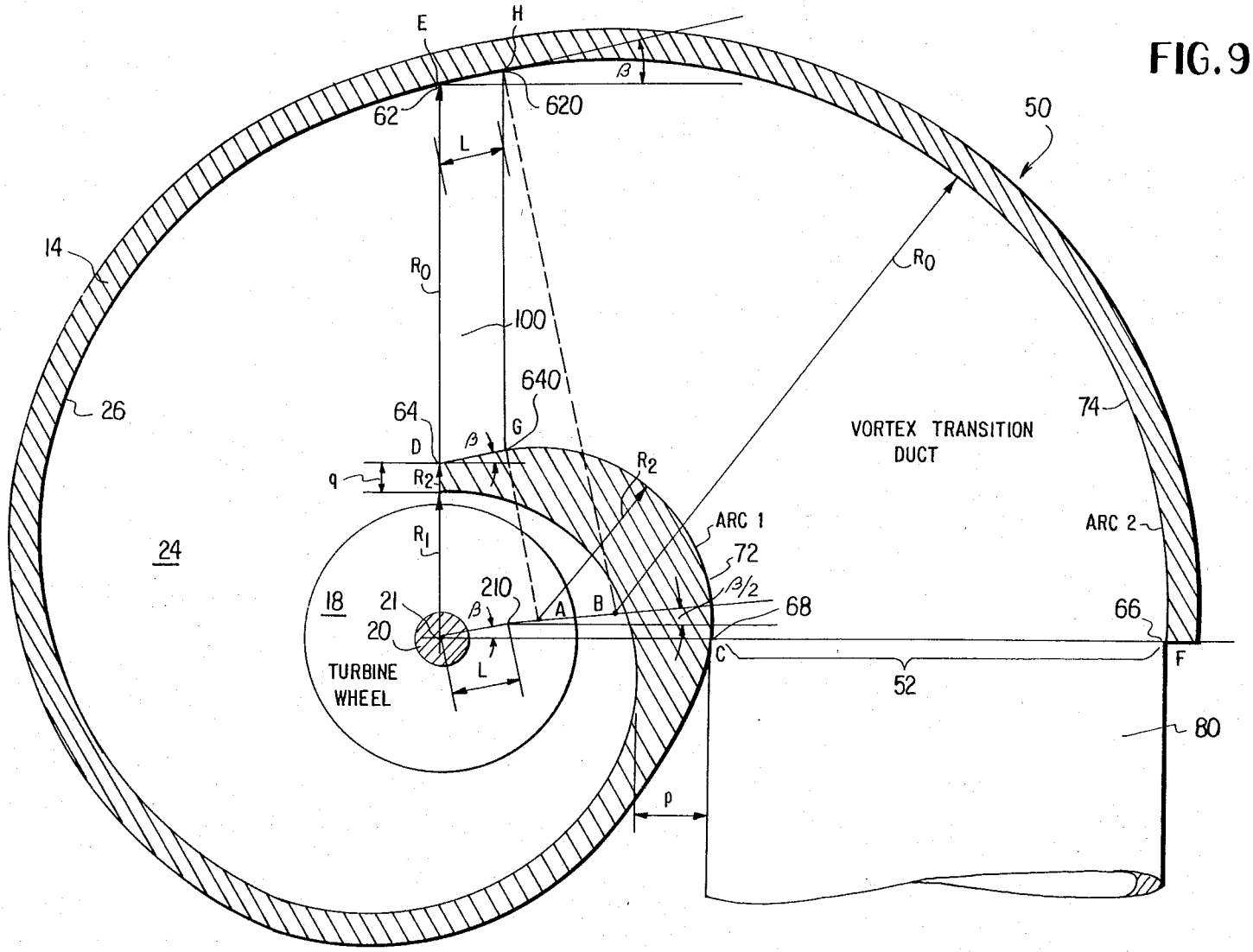
FIG. 9 is a view similar to FIG. 3, and illustrates a second embodiment of the transition duct of this invention.

In the embodiment of FIG. 9, wherein like numerals correspond to the embodiment of FIG. 3, the angles alpha and beta are equal to thereby yield a smooth transition between Arc 2 (denoted by 74) and the volute surface 26. This follows by virtue of the manner of constructions presently to be described. The entrance to the volute 24 and the terminal end of transition duct 50 are effectively separated by an inserted duct segment 100. Opposite walls of duct 100 are parallel, with a line segment joining points 62 and 620 being coincident with the tangent to the volute at the entrance of the latter. The length of inserted duct 100, in a direction parallel to this tangent, is denoted by L.

The construction of Arc 1 (surface 72) and Arc 2 (surface 74) is the same as that of the embodiment of FIG. 3, except that reference, from the turbine wheel axis of rotation 21, is now translated to a new point 210. This new point is translated along the angle beta a distance L from axis 21. The length $\overline{OA}$ which is the distance from the center of rotation of the turbine wheel to the center of surface 72 (Arc 1) is given as $$\overline{OA} = \{L^2 + 2R_2^2(\sin^2 \beta + 2 \sin^4 \beta/2)\}^{\frac{1}{2}}$$

The length $\overline{OB}$ which is the distance from the center of rotation 21 of the turbine wheel to the center of surface 74 (Arc 2) is given as $$\overline{OB} = \{L^2 + 2R_o^2(\sin^2 \beta + 2 \sin^4 \beta/2)\}^{\frac{1}{2}}$$

Figure 10:
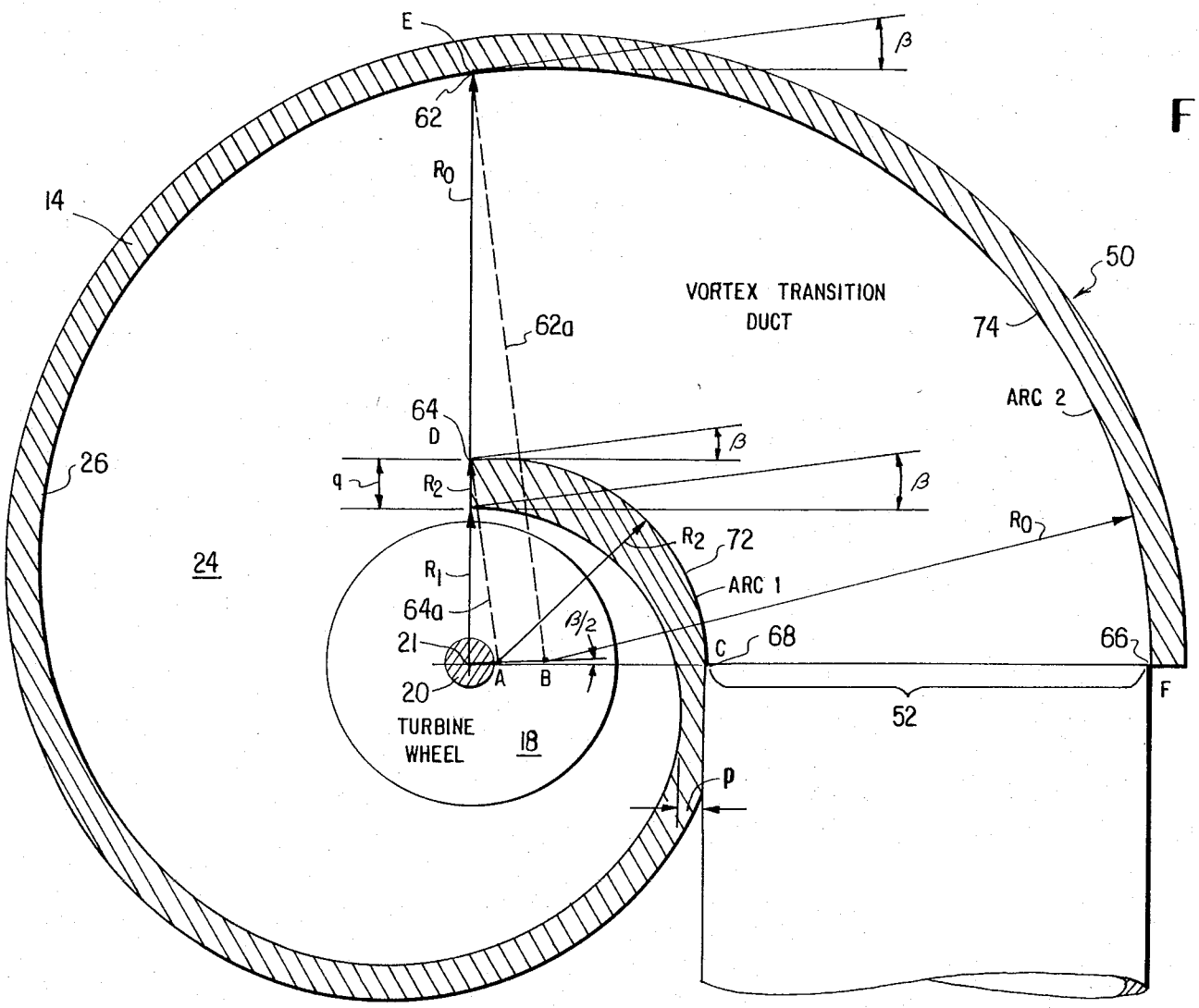
FIG. 10 is a view similar to FIG. 3, and illustrates a third embodiment of the transition duct of this invention.

In FIG. 10 another embodiment of the invention is illustrated and exhibits the smooth streamline flow of the embodiment of FIG. 9, although of a somewhat different form. The method of construction of the surface 74 (Arc 2) and 72 (Arc 1) is as follows.

To construct surface 74, a line is drawn from point 62, the line being at right angles to the tangent to the volute surface 26 at point 62. This line is denoted by 62*a*. Next, the length $R_o$ is measured along 62*a* from point 62 to establish point B, whereupon an arc of radius $R_o$ is struck from points 62 to 64 to establish surface 74.

To construct surface 72, the length $R_2$ is first determined. Next, a perpendicular is drawn from a line segment which is of an angle beta to the horizontal to point 64. This is line 64*a*. With point 64 as center, an arc of radius $R_2$ is drawn which intersects line 64*a*. This intersection is the center A of surface 72. Then draw Arc 1 between points D and C with radius $R_2$ to establish surface 74. In the event that this procedure results in a thickness p less than required for strength, $R_2$ is increased, and the above steps repeated until the required minimum thickness for p results. The line segment $\overline{OAB}$ is at an angle of one-half beta from the horizontal. The length $\overline{OA}$ is $$\overline{OA} = 2R_2 \sin \beta/2$$

and the length $\overline{OB}$ by $$\overline{OB} = 2R_o \sin \beta/2$$

Figure 11:
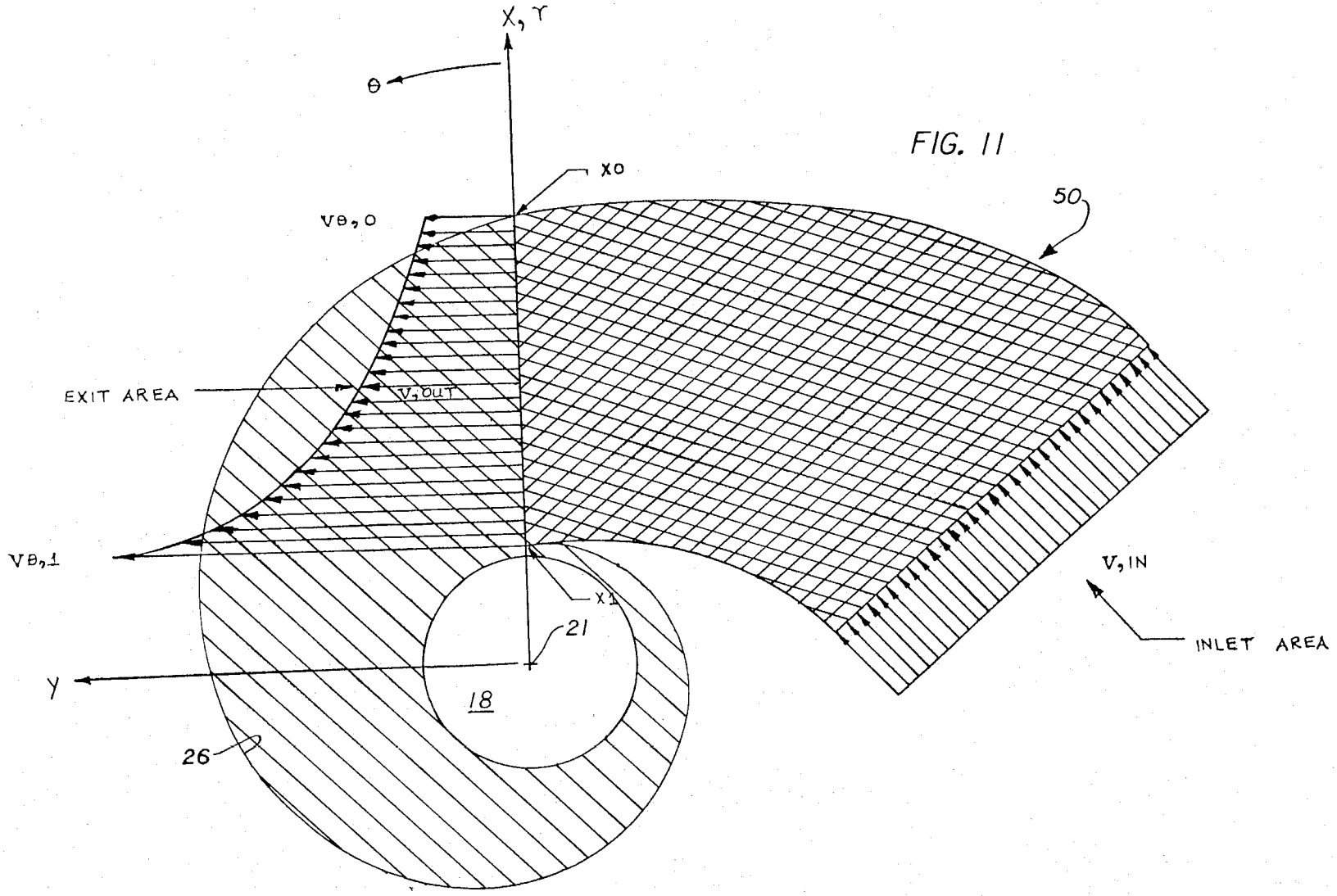
FIG. 11 is a cross-sectional view of a generalized three-dimensional vortex generating transition duct as applied to a typical prior art turbine volute, illustrating inlet and outlet velocity distributions of the gas.

Referring now to FIG. 11, the cross-hatched area represents duct 50 which is convergent from its inlet area to its exit area. Due to well-known fluid mechanics laws, when fluid passes through the inlet area of a curved convergent duct, the gas properties will not remain the same throughout the duct. If, for instance, the velocity profile at the inlet of the duct is uniform, the curvature and convergence of the duct will skew the velocity profile such that a different velocity profile will occur at the duct exit.

The geometry of the duct is so fashioned in accordance with this invention to produce the desired free vortex velocity profile defined by the following equation at the duct exit:

$$X \times V_\theta = \text{Constant}$$

The generalized transition duct shown in FIG. 11 is comprised of surfaces 90 and 92 and connecting surfaces, one each above and below the cross-section illustrated. The required geometry variation to effect a free vortex velocity distribution can be achieved by appropriate curvature of any of these surfaces, or any combination of surfaces given the geometry of the remaining surfaces, such that the above equation is satisfied.

FIG. 12 illustrates a conventional internal combustion engine 150 whose exhaust is fed to the vortex transition duct and turbine of this invention. The turbine wheel 18 may be, conventionally, mounted on the same shaft as that upon which is mounted a compressor wheel of a compressor 152, the common mounting indicated by a dashed line. Compressor output is fed, as is conventional, to the intake manifold of engine 150.

It is claimed:

1. A radial inflow turbine construction, the turbine adapted to be employed with a compressor in a turbocharger for supercharging an internal combustion, reciprocating piston engine, the turbine including a radial inflow turbine wheel, a generally annular turbine volute housing having an inlet entrance opening for receiving exhaust gases from an internal combustion engine, the turbine wheel mounted for rotation within the housing, the volute housing interior defining an arcuate nozzle for discharging exhaust gas fed from an internal combustion engine into the housing inlet to the turbine wheel, the radially outermost surface of the arcuate nozzle being in the form of a spiral, so that the radially outermost surface of the nozzle becomes progressively nearer in passing into the turbine volute using, to the periphery of the turbine wheel, engine exhaust gases adapted to pass from the turbine housing inlet through the arcuate nozzle and radially inwardly of the turbine wheel to cause the turbine wheel to rotate, means coupled between the exhaust gas supply of an internal combustion engine and the exhaust gas inlet of the turbine volute housing for imparting a free vortex distribution of velocities to the exhaust gas as it enters the turbine volute housing, said means for imparting a free vortex velocity distribution being a vortex transition duct mounted with its exit end feeding engine exhaust gas into the inlet of the turbine housing, the transition duct having a radially innermost and a radially outermost wall, at least one of said walls varying in width along the length of the duct, whereby lower gas losses and improved gas turbine efficiency are both realized as compared to a distribution of velocities at the turbine housing inlet which is other than a free vortex distribution.

2. The vortex transition duct of claim 1 wherein the duct has a radially outermost wall and a radially innermost wall, the edges of said walls having side wall members to thereby define a closed duct, the width of said radially outermost wall varying from its input end to its output end, the width of said radially innermost wall also varying from its input end, these two width variations being opposite, whereby one of said widths is converging and the other is diverging.

3. The radial inflow turbine construction of claim 2 wherein the input to the turbine housing matches the shape of the exit of the vortex transition duct.

4. The radial inflow-turbine construction of claim 3 wherein the angular extent of the vortex transition duct is about 90 degrees.

5. The radial inflow turbine construction of claim 2 wherein the radially innermost and the radially outermost walls of the vortex transition duct are straight in transverse cross-section of said duct.

6. The radial inflow turbine construction of claim 5 wherein the side walls of the vortex transition duct are straight in transverse cross-section of said duct, whereby the duct is polygonal in cross-section, the lengths of the straight lines forming the polygonal shape vary in passing from one end of the transition duct to its other end.

7. The radial inflow turbine construction of claim 6 wherein one end of the transition duct is rectangular in cross-section and the other end is trapezoidal in cross-section.

8. The radial inflow turbine construction of claim 7 wherein at one radius $R_x$, measured from the axis of rotation of the turbine wheel, the width of the trapezoidal cross-section is equal to the width of the rectangular cross-section.

9. The radial inflow turbine construction of claim 7 wherein the exhaust gas inlet of the vortex transition duct is rectangular and its exhaust gas outlet is trapezoidal.

10. The radial inflow-turbine construction of claim 6 wherein the angular extent of the vortex transition duct is about 90 degrees.

11. The radial inflow-turbine construction of claim 5 wherein the angular extent of the vortex transition duct is about 90 degrees.

12. The radial inflow-turbine construction of claim 2 wherein the angular extent of the vortex transition duct is about 90 degrees.

13. The radial inflow-turbine construction of claim 2 wherein the radially innermost and radially outermost wall surfaces of the vortex transition duct are circular arcs as projected on a plane orthogonal to the axis of rotation of the turbine wheel.

14. The radial inflow turbine construction of claim 13 wherein the centers of the two circular arcs are at different locations.

15. The radial inflow turbine construction of claim 14 wherein the radius of curvature of the radially innermost circular arc is $R_2$ ($R_2$ being the distance between the axis of rotation of the turbine wheel and the radially innermost edge of the generally trapezoidal entrance of the turbine housing in said plane) and whose center is determined by the intersection first and second locating arcs, the first locating arc being of radius $R_2$ whose center, in said plane, is located at said radially innermost edge of the generally trapezoidal inlet to the turbine volute, the second locating arc being of radius $R_2$ whose center, in said plane, is located at the radially innermost edge of the vortex transition duct inlet, and wherein the radius of curvature of radially outermost circular arc is $R_o$ ($R_o$ being the distance between the axis of rotation of the turbine wheel and the radially outermost edge of the generally trapezoidal entrance of the turbine housing in said plane) and whose center is determined by the intersection of (1) the extension of a line, in said plane, from the axis of rotation of the turbine wheel through the center of curvature of said radially innermost circular arc, with (2) an arc, in said plane, of radius $R_o$ with center at the radially outermost edge of the generally trapezoidal inlet to the turbine volute.

16. The radial inflow turbine of claim 13 wherein the duct surfaces $R_2$ and $R_o$ are determined in the same manner, except that the center of rotation of the turbine is considered, for this determination, to be translated a distance L along a line of inclination beta from the center of rotation of the turbine, whose beta is the angle, from the horizontal, of the tangent to the volute of its radially outermost entrance, and wherein L is the width, taken along a direction parallel to said tangent, of an inserted duct segment which is positioned between and joins the entrance of the turbine volute to the exit of the transition duct, whereby aerodynamic discontinuities are minimized.

17. The radial inflow-turbine construction of claim 1 wherein the angular extent of the vortex transition duct is about 90 degrees.

18. The radial inflow turbine of claims 1, 2, 3 or 5 wherein the inlet to the turbine and the outlet of the vortex transition duct are coupled by an inserted duct segment.

* * * * *

UNITED STATES PATENT AND TRADEMARK OFFICE

CERTIFICATE OF CORRECTION

PATENT NO. : 4,512,716

DATED : April 23, 1985

INVENTOR(S) : M. Louise McHenry and Robert C. Bremer, Jr.

It is certified that error appears in the above-identified patent and that said Letters Patent is hereby corrected as shown below:

Claim 2, column 7, line 62, should read

--The radial inflow turbine construction of claim 1 wherein the vortex transition --

Claim 3, column 8, line 3, should depend from claim 1.

Claim 4, column 8, line 6, should depend from claim 1.

Claim 10, column 8, line 33, should depend from claim 2.

Claim 12, column 8, line 39, should depend from claim 5.

Signed and Sealed this

*Twenty-second* Day of *October 1985*

[SEAL]

*Attest:*

*Attesting Officer*

DONALD J. QUIGG

*Commissioner of Patents and Trademarks—Designate*